United States Patent [19]

Uimonen

[11] Patent Number: 4,711,038

[45] Date of Patent: Dec. 8, 1987

[54] RUN-THROUGH BRICK DRYING PLANT AND METHOD FOR THE CONTROL OF ITS OPERATION

[75] Inventor: Matti Uimonen, Lahti, Finland

[73] Assignee: Tekma Oy, Lahti, Finland

[21] Appl. No.: 749,537

[22] PCT Filed: Nov. 15, 1983

[86] PCT No.: PCT/FI83/00072

§ 371 Date: Jun. 21, 1985

§ 102(e) Date: Jun. 21, 1985

[87] PCT Pub. No.: WO85/02249

PCT Pub. Date: May 23, 1985

[51] Int. Cl.[4] ..... F26B 3/04

[52] U.S. Cl. ..... 34/25; 34/31; 34/52; 34/204

[58] Field of Search ..... 34/204, 210, 212, 213, 34/214, 216, 217, 48, 30, 31, 34, 52, 25

[56] References Cited

U.S. PATENT DOCUMENTS

| | | | |
|---|---|---|---|
| 1,783,030 | 11/1930 | Worden . | |
| 2,547,833 | 4/1951 | Parkes et al. | 34/191 |
| 2,758,386 | 8/1956 | Cobb | 34/191 |
| 2,799,096 | 7/1957 | Scott | 34/213 |
| 4,204,337 | 5/1980 | Roos et al. | 34/52 |
| 4,251,925 | 2/1981 | Muhsil et al. | 34/216 |

FOREIGN PATENT DOCUMENTS

| | | |
|---|---|---|
| 1462448 | 12/1966 | France . |
| 319431 | 1/1970 | Sweden . |
| 321895 | 3/1970 | Sweden . |

*Primary Examiner*—Larry I. Schwartz

*Attorney, Agent, or Firm*—Cushman, Darby & Cushman

[57] ABSTRACT

Run-through brick drying plant, which operates by the chamber dryer principle. The brick loads (T) to be dried are brought through a front door (16*a*) into the drying chamber ($K_1$). After drying, the brick loads (T) are removed from the opposite side of the drying plant through the rear door (16*b*). The brick drying plant comprises two or more drying chambers ($K_1$,$K_2$,$K_3$) connected in series, each of which said chambers ($K_n$) operates independently so that, when the brick loads (T) are shifted from the preceding drying chamber ($K_n$) into the subsequent drying chamber ($K_{n+1}$), in the latter chamber ($K_{n+1}$) the drying of the brick load (T) is continued substantially from the point of the drying formula that had been reached in the drying in the preceding chamber ($K_n$). There are at least two, preferably three or more, drying chambers (K) in series, and there are one or more groups of chambers obtained in this way, side by side. Moreover, a novel control method is described for controlling the operation of the drying plant.

7 Claims, 7 Drawing Figures

RUN-THROUGH BRICK DRYING PLANT AND METHOD FOR THE CONTROL OF ITS OPERATION

The present invention is concerned with a run-through brick drying plant, which operates by the chamber dryer principle, in which the brick loads to be dried are brought on an inlet conveyor through a front door into the drying chamber, and out of which drying plant the brick loads are, after drying, removed from the opposite side of the drying plant through the rear door.

The invention is further concerned with a control method for the brick drying plant subject of the invention.

In prior art, as lumber drying plants, so-called run-through chamber drying plants are known. Their construction is such that dryer loads consisting of dryer packages are brought into the drying chamber along a roll track placed ahead of the drying plant, from which the loads are pushed into the dryer chamber. The ready dried loads are taken out through the opposite door of the dryer chamber. It is an advantage of these prior-art chamber dryers that therein the time of exchange of the load is relatively short. A drawback is, however, the costly and complicated construction of the drying plants.

It is an object of the present invention to provide a simple solution which permits a substantial reduction in the drawbacks stated above as well as to provide such a chamber drying plant in which the above properties of a chamber drying plant are retained.

It is a further object of the present invention to provide such a brick drying plant in which the drying of the bricks can be carried out more advantageously and economically than in prior art.

One of the goals of the invention is to provide a novel control method for a brick drying plant, which method can be accomplished by means of relatively simple control devices.

The brick drying plant in accordance with the invention is mainly characterized in that the brick drying plant comprises two or more drying chambers connected in series, each of which said chambers operates independently so that, when the brick loads are shifted from the preceding drying chamber into the subsequent drying chamber, in the latter chamber the drying of the brick load is continued substantially from the point of the drying formula that had been reached in the drying in the preceding chamber.

On the other hand, the control method in accordance with the invention is mainly characterized in that such a control system has been fitted so as to control the operation of the group of drying chambers connected in series with each other as has as many control units as there are drying chambers in the said group of drying chambers, and that, after a drying formula in accordance with the brick load to be dried at each particular time has been fed into a certain control unit, the control signal of the said control unit is arranged so that it follows along with the brick load concerned to be dried and so that it is connected so as always to control the control devices of the drying chamber in which the load concerned to be dried is at each particular time.

In the brick drying plant in accordance with the invention, the advantages characteristic of a chamber drying plant have been retained. Moreover, such a chamber drying plant for brick loads has been provided in which exactly the desired drying formula can be followed accurately in a way advantageous in view of both the drying result and the energy consumption. For its part, the control method in accordance with the invention permits the reaching of the goals described above by means of a control equipment of simple construction and operation.

In the following, the invention will be described in detail with reference to one exemplifying embodiment of the invention, illustrated in the figures of the attached drawing, whereby the invention is by no means strictly confined to the details of the said embodiment.

In the following, the construction and the operation of the chamber drying plant will be described with reference to FIGS. 1 to 4. The drying chambers $K_1$ to $K_N$ (N pcs.) of the drying channels of the chamber drying plant, connected in series with each other, operate independently. When the brick loads $T_1$ are shifted from the first chamber $K_1$ into the second drying chambers $K_2$, after this transfer the drying is continued as if no transfer at all had been performed, in other words, after the transfer, the drying formula (e.g., in FIG. 7) starts being followed in the second chambers $K_2$ from the drying point that had been reached in the drying in the first chambers $K_1$. The drying takes place in a corresponding way when the brick loads $T_2$ are shifted into the third drying chambers $K_3$, when the brick loads $T_3$ are shifted into the fourth drying chambers $K_4$, if any, etc. There may be an appropriate number of drying chambers K connected in series, at least two, and for example three, as is shown in FIG. 5.

Figure 1:
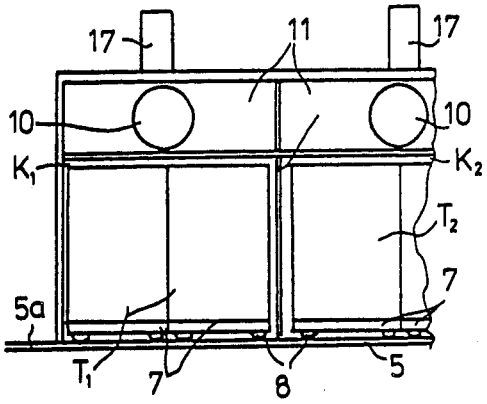
FIG. 1 is a vertical sectional view of drying chambers in accordance with the invention on an enlarged scale.
Figure 2:
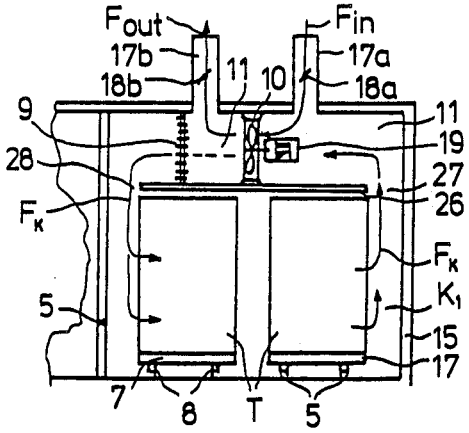
FIG. 2 is a vertical sectional view of the first chamber of the drying channel in the direction opposite to that shown in FIG. 1.

The arrangement of the circulation $F_k$ of the drying air in the drying chambers K is shown best in FIG. 2. In each drying chamber there is a batch of four brick loads and two brick loads T side by side, and the circulation flow $F_k$ of drying air is blown through the brick loads. Above the drying chambers K, there is an intermediate plane 26, and at its both sides there are air flow openings 27 and 28. The opening 27 opens into the air flow duct 11 placed above the drying chambers, which duct 11 includes a blower 10 driven by a motor 19. At the intake side of the blower 10 in the duct 11, the duct **17*a* for intake air $F_{in}$ opens, which said duct 17*a* is provided with a control damper 18*a*. At the pressure side of the duct 11, there is an outlet air duct 17*b*, which is provided with a control damper 18*b*. Moreover, at the pressure side of the duct 11, there is a heating radiator 9** for the circulation air $F_k$. The inlet air flows $F_{in}$ are introduced through the ducts 17a to the intake side of the blowers 10, which said flows $F_{in}$ can be heated, all of them together, by means of a heater (not shown). Correspondingly, the outlet air flows $F_{out}$ are taken from the pressure side of the blowers 10 through the ventilation ducts 17b. The ventilation ducts 17a and 17b are provided with control dampers 18a and 18b, by means of which, together with adjustment of the radiators 9, it is possible to act upon the condition and drying capacity of the circulation air $F_k$.

The blower 10 is arranged as of reversible direction, whereby, correspondingly, the intake and pressure sides of the blower 10 are interchanged and, at the same time, the inlet air duct 17a becomes outlet air duct, and the outlet air duct 17b becomes inlet air duct as the direction of the circulation air flow $F_k$ is reversed. The objective of the reversing of the circulation air flow $F_k$ is that the brick loads are dried uniformly irrespective of whether there are one or more of them side by side in the drying chamber. The reversing of the direction of the circulation air flow $F_k$ described above is performed at appropriate intervals, e.g., of about 2 hours.

The dryer channels, which have two or preferably more dryer chambers $K_1$ to $K_N$ as connected in series, may have 1, 2, 3 or more tracks so that, in each chamber, there is a number of brick loads equal to the number of tracks placed side by side. In accordance with FIGS. 1 to 4, there are two brick loads, one after the other, in each dryer chamber 7.

An example of the loads T in a drying plant is a load consisting of $20\times6\times14$ pcs. = 1,680 pcs. of bricks. In the loads $T_1$ in the drying plant, the brick layers are, in a way in itself known, placed on shelves so that an efficient current of air $F_k$ is produced through the loads T in the drying plant.

Figure 3:
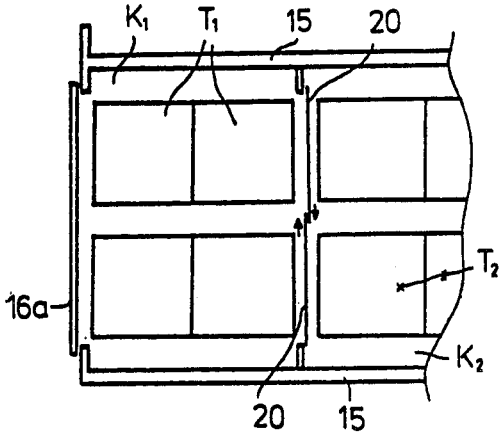
FIG. 3 is a horizontal sectional view of the initial end of the drying channel of the invention.

As is shown in FIG. 3, there is a lightweight partition wall 20 between the dryer chambers $K_1$,$K_2$, etc. placed one after the other and connected in series. The partition walls 20 are made, e.g., of a flexible cloth-like material, because they need not be heat-insulating. The partition walls 20 separate the adjoining dryer chambers K, connected in series, from each other and permit independent drying in each chamber K. The partition walls 20 may be, e.g., of an accordian-type construction and such that they can be pulled to the side and/or upwards when the load T in the drying plant moves from the preceding chamber $K_n$ into the following chamber $K_{n+1}$.

Figure 4:
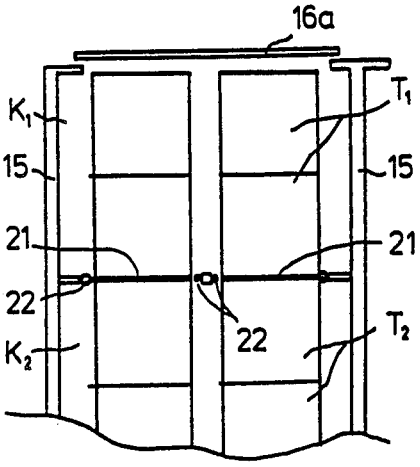
FIG. 4 shows a second embodiment of the partition wall between the drying chambers in a way corresponding to FIG. 3.
Figure 5:
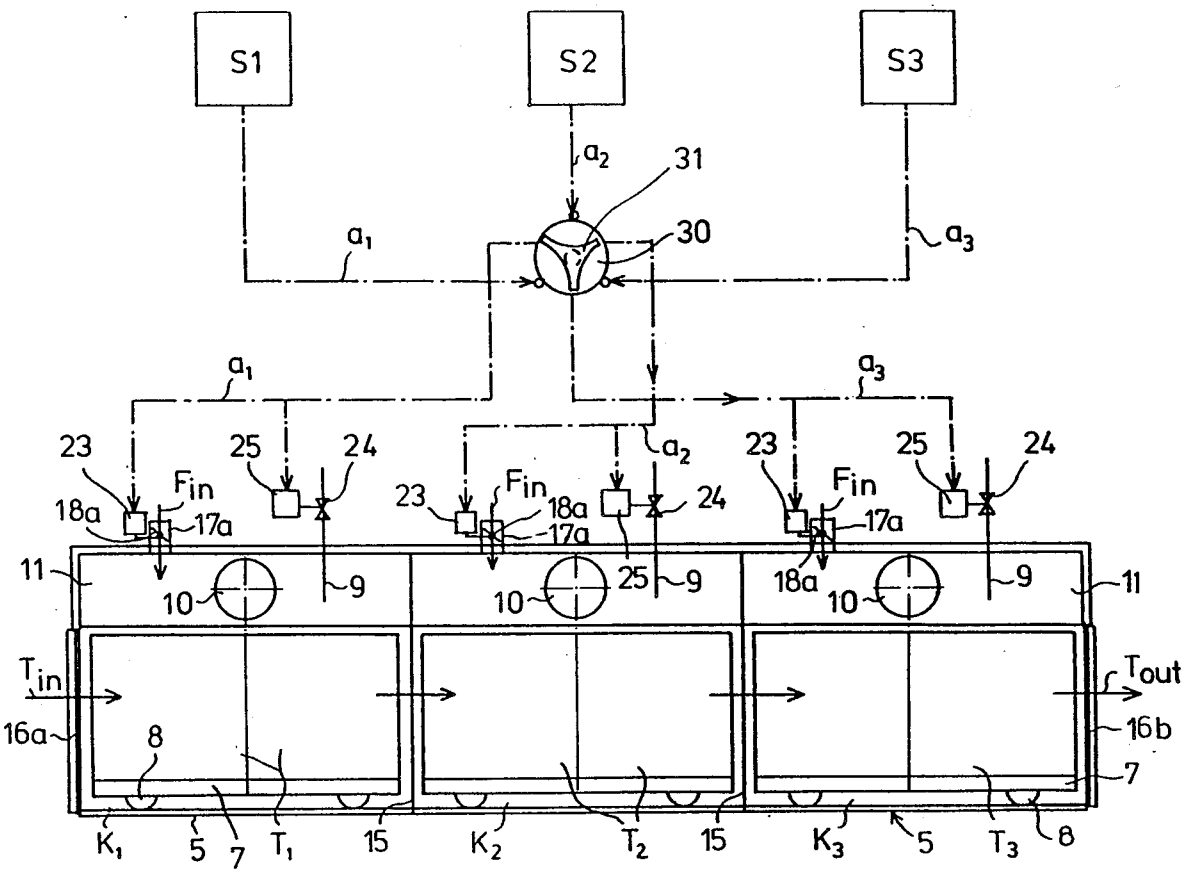
FIG. 5 shows the control system of the operation of a brick drying plant in accordance with the invention schematically and partly as a block diagram.

FIG. 4 shows an alternative solution for the construction of the partition wall between the drying chambers K. According to FIG. 4, the dryer wagons 7 are provided with end walls 21 which function as partition walls of the drying chambers. If required, the edges of the end walls 21 of the dryer wagons 7 and/or the walls 15 of the drying channels or equivalent are provided with seals, which are in FIG. 4 denoted schematically with reference numerals 22. The use of the ends 21 of the dryer wagons as partition walls of the drying chambers K is partly permitted by the fact that the dimensions of the brick loads T are accurate.

Figure 6:
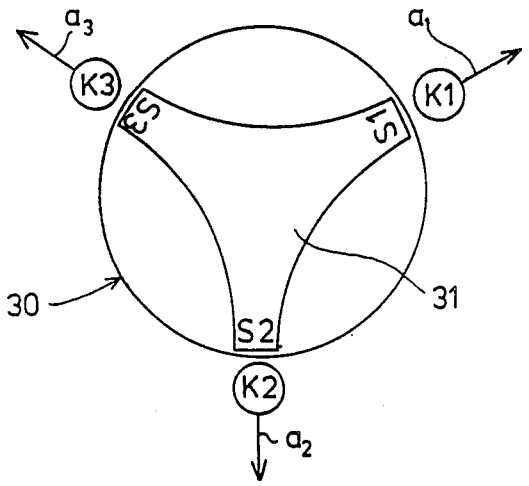
FIG. 6 shows the principle of the selection switch for the program circulation, belonging to the control system shown in FIG. 5.

In the following, with reference to FIGS. 5, 6 and 7, the new control system in accordance with the invention, controlling the operation of the chamber drying plant, will be described, which said system comprises three separate control centres $S_1$, $S_2$, and $S_3$.

The position of the control dampers 18a provided in the inlet air ducts 17a is controlled by means of control motors 23. Correspondingly, the position of the control valve 24 of the heating radiator 9 is controlled by means of control motors 25. Each drying chamber $K_1$, $K_2$ and $K_3$ has its own control means for the heating radiator 9 for intake air and drying air.

In accordance with the program that is being fed into them, in a way in itself known, at each particular time, the said control centres S give a control signal $a_1$,$a_2$ and $a_3$, each of them in its turn, to control the operation of the control motors 23,25 of the different chambers $K_1$,$K_2$ and $K_3$. If necessary, the control system may include measurement and feedback devices, by means of which, e.g., the state of the drying air circulating in the different drying chambers $K_1$,$K_2$,$K_3$ is observed, and, accordingly, the control signals $a_1$, $a_2$ and $a_3$ are acted upon. The control signals $a_1$,$a_2$,$a_3$ may also be formed with the principle of "blind" control, and in such a case the said feedback arrangements are unnecessary.

In the following, with reference to FIGS. 5, 6 and 7, the operation of the drying plant in accordance with the invention and of its control system will be described. When the nature of the brick load coming into the first chamber $K_1$, i.e. the dimensions of the bricks and possibly their humidity, are known, a drying formula is fed into the control centre $S_1$ in a way in itself known, which said formula is followed in respect of the load $T_1$ through the entire drying channel $K_1$ to $K_3$.

Figure 7:
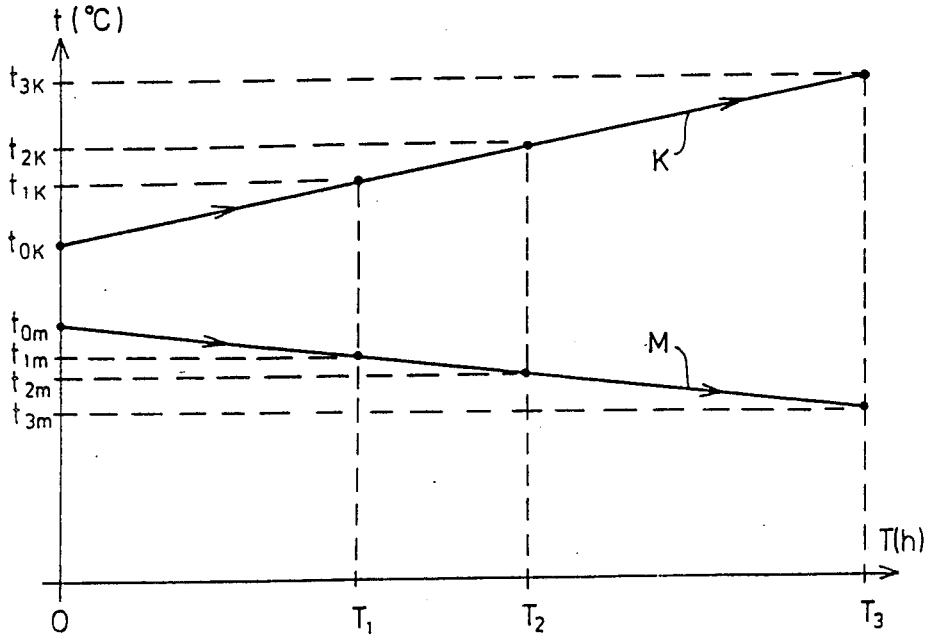
FIG. 7 shows an example of a drying formula followed in a drying plant in accordance with the invention, which formula is accomplished by means of the control system shown in FIGS. 5 and 6.

FIG. 7 illustrates one possible example of a drying formula. The drying of a fresh load $T_1$ introduced into the chamber $K_1$ will be followed by means of FIG. 7. In FIG. 7, the straight line K stands for the dry temperature $t_k$ of the drying air, and the straight line M for the corresponding wet temperature $t_m$. The horizontal axis T indicates the drying time, and the vertical axis t indicates the said temperatures $t_k$ and $t_m$ of the drying air as °C. By means of the control signal $a_1$ of the control centre $S_1$, which signal is, at the initial stage of the operation, controlled so as to act upon the control motors 23 and 25 of the first chamber $K_1$, while following the drying formulae K and M, during the period 0 to $T_1$, drying is carried out from the dry temperature $t_{0k}$ to the temperature $t_{1k}$ and from the wet temperature $t_{0m}$ to the wet temperature $t_{1m}$. Hereupon the brick load $T_1$ is transferred into the next chamber $K_2$.

According to the present invention, at the same time as the dryer load $T_1$ is transferred from the first drying chamber $K_1$ into the second drying chamber $K_2$, the switch 31 of the selector device 30 is turned, or controlled by means of an automatic system (not shown) so that it is turned, so that the control signal $a_1$ follows the dryer load, i.e. the control signal $a_1$, which comes from the first control centre $S_1$, now starts controlling the operation of the second chamber $K_2$ by means of the control motors 23 and 25. Thus, the drying is continued, while following the drying formulae K and M, in the second chamber $K_2$ as if no transfer at all had been carried out in respect of the drying formula and of the control of the control devices. However, the brick load $T_1$ has been shifted out of the first chamber $K_1$ into the second chamber $K_2$, and a new load has been introduced into the first chamber $K_1$, and the controlling of the drying of the said new load is performed, in accordance with FIG. 5, by the control centre $S_3$, which has become free from the controlling of the drying of the load $T_3$ removed out of the last chamber $K_3$ and into which control centre $S_3$ the drying formula required by the new load has been programmed.

In the second chamber $K_2$, in accordance with FIG. 7, drying is performed within the period $T_2$-$T_1$ to the dry temperature $t_{2k}$ and to the wet temperature $t_{2m}$, whereupon the load is transferred into the next drying chamber $K_3$ and, at the same time, the selection switch 31 is turned to the next position, wherein the control signal $a_1$ of the control centre $S_1$ is controlled so as to act upon the control motors 23 and 25 of the third chamber $K_3$.

In the last chamber $K_3$, the drying of the said load T is performed within the period of time $T_3$-$T_2$ to the ultimate dry temperature $t_{3k}$ and wet temperature $t_{3m}$ as controlled by the same control centre $S_1$ under whose control the drying was started in the first chamber $K_1$ and carried out in the second chamber $K_2$.

Hereinafter the said load T is removed through the rear door 17, and the control centre $S_1$ becomes free for the control of the drying of the next brick load, and the drying formula in accordance with this new load is programmed into the said centre, and its control signal $a_1$ is passed through the selection switch 31 so as to act upon the first drying chamber $K_1$.

As has come out above, in drying plants, as a rule, there are several groups of dryer chambers $K_1$ to $K_N$ connected in parallel. In such a case, each group of dryer chambers $K_1$ to $K_N$ has a control system of its own, which has as many (N pcs.) independently operating control units $S_1$ to $S_N$ as there are, in the group of dryer chambers controlled by it, dryer chambers placed one after the other and connected in series.

Owing to the control system in accordance with the invention, the important practical advantage is accomplished that for each brick load to be dried, only one programming of the control centre has to be performed, because the control centre "follows" the load to be dried into all of the different chambers through which the load passes during the drying.

In the following, the patent claims will be given, and the various details of the invention may show variation within the scope of the inventive idea defined in the said claims.

What is claimed is:

1. A run-through brick drying apparatus which operates stepwise by the chamber dryer principle comprising a plurality of drying chambers connected in a series with one of said chambers being the first and one being the last drying chamber in said series, a plurality of brick load conveying means, means for moving each conveying means through said chambers, means for controlling the movement of said conveying means pursuant to a selected drying schedule so that, for each conveying means, a selected dwell time in each drying chamber and a selected drying temperature in each chamber is effected whereby drying of each brick load is completed in the last chamber, said conveying means comprising dryer wagons and each said wagon being provided with a vertical wall which functions as a partition wall between said chambers as each said wagon is moved through said chambers.

2. The brick drying apparatus as claimed in claim 1 wherein at least three drying chambers are provided.

3. Brick drying apparatus as claimed in claims 1 or 2, characterized in that between said drying chambers there is a light-weight partition wall, which permits running through of the brick loads from the preceding chambers into the following chambers.

4. In a method of operating a run-through brick drying apparatus of the type having a plurality of chambers arranged in a series from a first to a last drying chamber, a plurality of brick load conveying means, means for moving each conveying means through said chambers from said first through said last chamber, each chamber having a control unit for regulating the drying condition in said respective chamber and means for controlling the movement of said conveying means and the operation of each said control unit of each said chamber, including means for progressively operating each said control unit of said chambers in a sequence correlated to the movement of a specific brick load therethrough, the steps comprising:

moving a first load of bricks on a said conveying means into the first chamber in which the drying condition is selected by a signal between said means for controlling and said control unit of said first chamber;

then, after a selected time period, moving said first load in sequence to subsequent chambers and transferring by a signal between said means for controlling and said respective control units of each said subsequent chamber and the selected drying condition from said first chamber to each said subsequent chamber at least while said first brick load is present in each said subsequent chamber so that, complete drying is effected while said first brick load is in said last chamber;

said apparatus being of a type including a selector means which sequentially passes a control signal from said means for controlling to said respective control units and the method including the step of controlling said selector means in correlation to the movement of a said brick load through said chambers;

said selector means being provided with means for sending a plurality of discrete signals to discrete ones of said control units and the method including the step of transferring a plurality of brick loads through said drying apparatus with each brick load assigned a specific drying condition that is transferred sequentially in correlation to the movement of a said brick load through said chambers.

5. The method as claimed in claim 4 wherein each said control unit controls a damper for inlet air and a heating radiator for the drying air and the method comprises the steps of actuating each said control unit to vary the inlet air and the heating radiator to adapt each said respective chamber to a selected drying condition.

6. In a method of operating a run-through article drying apparatus of the type having a plurality of chambers arranged in a series from a first to a last drying chamber, a plurality of article load conveying means, means for moving each conveying means through said chambers from said first through said last chamber, each chamber having a control unit for regulating the drying condition in said respective chamber and means for controlling the movement of said conveying means and the operation of each said control unit of each said chamber, including means for progressively operating each said control unit of said chambers in a sequence correlated to the movement of a specific article load therethrough, the steps comprising:

moving a first load of articles on a said conveying means into the first chamber in which the drying condition is selected by a signal between said means for controlling and said control unit of said first chamber;

then, after a selected time period, moving said first load in sequence to subsequent chambers and transferring by a signal between said means for controlling and said respective control units of each said subsequent chamber and the selected drying condition from said first chamber to each said subsequent chamber at least while said first article load is present in each said subsequent chamber so that, complete drying is effected while said first article load is in said last chamber;

said apparatus being of a type including an address means which sequentially passes a control signal from said means for controlling to said respective control units and the method including the step of controlling said address means in correlation to the movement of a said article load through said chambers;

said address means being provided with means for sending a plurality of discrete signals to discrete ones of said control units and the method including the step of transferring a plurality of article loads through said drying apparatus with each article load assigned a specific drying condition that is transferred sequentially in correlation to the movement of a said article load through said chambers.

7. A run-through article drying apparatus which operates stepwise by the chamber dryer principle comprising a plurality of drying chambers connected in a series with one of said chambers being the first and one being the last drying chamber in said series, a plurality of article load conveying means, means for moving each conveying means through said chambers, means for controlling the movement of said conveying means pursuant to a selected drying schedule so that, for each conveying means, a selected dwell time in each drying chamber and a selected drying temperature in each chamber is effected whereby drying of each article load is completed in the last chamber, said conveying means comprising dryer wagons and each said wagon being provided with a vertical wall which functions as a partition wall between said chambers as each said wagon is moved through said chambers.

* * * * *